US007866104B2

(12) United States Patent
Babinsky et al.

(10) Patent No.: US 7,866,104 B2
(45) Date of Patent: Jan. 11, 2011

(54) BASE STRUCTURE FOR SQUASH COURTS

(75) Inventors: Horst Babinsky, Stein/Traun (DE); Regina Beier, Stein (DE); Christa Oberhans, Stein (DE)

(73) Assignee: ASB-Systembau Horst Babinsky GmbH (DE)

( * ) Notice: Subject to any disclaimer, the term of this patent is extended or adjusted under 35 U.S.C. 154(b) by 223 days.

(21) Appl. No.: 11/749,416

(22) Filed: May 16, 2007

(65) Prior Publication Data

US 2008/0287221 A1 Nov. 20, 2008

(51) Int. Cl.
*E04F 15/22* (2006.01)

(52) U.S. Cl. ..... 52/403.1; 52/177; 52/306

(58) Field of Classification Search ..... 52/292, 52/263, 403.1, 308, 28, 177, 306; 472/92, 472/94; 40/607.06
See application file for complete search history.

(56) References Cited

U.S. PATENT DOCUMENTS 640,140 A * 12/1899 Lloyd ..... 40/565
1,667,484 A * 4/1928 Liese ..... 52/308
2,114,473 A * 4/1938 Labra ..... 428/435
2,421,171 A * 5/1947 Trautvetter et al. ..... 52/180
2,457,619 A * 12/1948 Yoeum ..... 62/235
3,085,474 A * 4/1963 Bourgeaux et al. ..... 359/598
3,318,057 A * 5/1967 Norsworthy ..... 52/126.6
3,324,614 A * 6/1967 Loewenau ..... 52/126.6
3,611,655 A * 10/1971 Loebner ..... 52/592.2
3,755,663 A * 8/1973 George, Jr. ..... 362/249.01
3,779,547 A * 12/1973 Pappas ..... 472/92
3,789,557 A * 2/1974 Harvey ..... 52/126.6
3,828,503 A * 8/1974 Hofmann ..... 52/393
3,872,623 A * 3/1975 Spaulding, Jr. ..... 49/169
3,946,529 A * 3/1976 Chevaux ..... 150/105
4,006,565 A * 2/1977 Thompson et al. ..... 52/18
4,068,840 A * 1/1978 Spaulding, Jr. ..... 472/94
4,102,101 A * 7/1978 Nielsen et al. ..... 52/263
4,303,969 A * 12/1981 Hamilton et al. ..... 362/153
4,321,778 A * 3/1982 Whitehead ..... 52/204.591
4,329,739 A * 5/1982 Loebner ..... 362/153
4,340,929 A * 7/1982 Konikoff et al. ..... 362/153
4,546,019 A * 10/1985 Schneider ..... 428/13
4,631,647 A * 12/1986 Ranney ..... 362/147
4,673,609 A * 6/1987 Hill ..... 428/187
4,682,459 A * 7/1987 Stephenson ..... 52/390
4,715,743 A * 12/1987 Schmanski ..... 404/9
4,720,789 A * 1/1988 Hector et al. ..... 463/33
4,737,764 A * 4/1988 Harrison ..... 362/153
4,754,372 A * 6/1988 Harrison ..... 362/565
4,907,361 A * 3/1990 Villard ..... 40/565
4,931,331 A * 6/1990 Owens ..... 428/47
5,095,412 A * 3/1992 French ..... 362/153
5,167,087 A * 12/1992 Plumly ..... 40/600

(Continued)

*Primary Examiner*—Brian E Glessner
*Assistant Examiner*—James Ference
(74) *Attorney, Agent, or Firm*—Schiff Hardin LLP

(57) ABSTRACT

A base structure for a ball court, and in particular a squash court, with a supporting structure resting on a base and a floor forming a playing surface resting on the supporting structure. The floor comprises a plurality of safety glass panes laid adjacent each other and which are freely vertically movable relative to one another and whose surface forming the playing surface is provided with a plurality of rough areas. The supporting structure has an elastic layer beneath the safety glass panes.

16 Claims, 2 Drawing Sheets

U.S. PATENT DOCUMENTS 5,254,040 A * 10/1993 Eller et al. ..... 472/94
5,297,368 A * 3/1994 Okada ..... 52/64
5,302,049 A * 4/1994 Schmanski ..... 404/42
5,312,109 A * 5/1994 Cagle ..... 473/446
5,363,579 A * 11/1994 Plumly ..... 40/600
5,390,090 A * 2/1995 Nau ..... 362/153
5,411,352 A * 5/1995 Eren ..... 404/31
5,465,534 A * 11/1995 Mittag ..... 52/126.6
5,524,373 A * 6/1996 Plumly ..... 40/600
5,593,786 A * 1/1997 Parker et al. ..... 428/426
5,634,309 A * 6/1997 Polen ..... 52/392
5,681,105 A * 10/1997 Nau ..... 362/153
5,711,118 A * 1/1998 Molnar ..... 52/177
5,715,636 A * 2/1998 Taylor ..... 52/308
5,848,837 A * 12/1998 Gustafson ..... 362/235
5,927,845 A * 7/1999 Gustafson et al. ..... 362/152
5,951,144 A * 9/1999 Gavigan et al. ..... 362/153
6,116,751 A * 9/2000 Remp ..... 362/153
6,199,335 B1 * 3/2001 Brenot et al. ..... 52/480
RE37,186 E * 5/2001 Hill ..... 428/187
6,227,968 B1 * 5/2001 Suzuki et al. ..... 463/7
6,410,835 B2 * 6/2002 Suzuki et al. ..... 84/464 R
6,450,886 B1 * 9/2002 Oishi et al. ..... 463/36
6,526,704 B1 * 3/2003 Berard et al. ..... 52/177
6,665,996 B2 * 12/2003 Chang ..... 52/799.1
6,673,292 B1 * 1/2004 Gustafson et al. ..... 264/149
6,732,478 B1 * 5/2004 Russell et al. ..... 52/28
6,802,164 B1 * 10/2004 Newbrough et al. ..... 52/311.1
6,824,639 B1 * 11/2004 Hill et al. ..... 156/230
6,886,209 B2 * 5/2005 Blum et al. ..... 15/215
6,905,413 B1 * 6/2005 Terao et al. ..... 463/40
7,021,786 B1 * 4/2006 Sandor, Sr. ..... 362/153
7,093,395 B2 * 8/2006 Hinault et al. ..... 52/43
7,135,217 B2 * 11/2006 Lansberry ..... 428/195.1
7,145,469 B2 * 12/2006 Kokonaski et al. ..... 340/815.4
7,265,322 B2 * 9/2007 Aengenheyster et al. .... 219/203
7,352,951 B2 * 4/2008 Gotfried ..... 385/147
7,442,423 B2 * 10/2008 Miller ..... 428/57
7,547,854 B1 * 6/2009 Anderson ..... 200/85 R
7,571,572 B2 * 8/2009 Moller, Jr. ..... 52/177
7,716,895 B2 * 5/2010 Fairorth et al. ..... 52/582.2
2003/0033779 A1 * 2/2003 Downey ..... 52/403.1
2003/0110720 A1 * 6/2003 Berard et al. ..... 52/263
2004/0154240 A1 * 8/2004 Hiraguri et al. ..... 52/144
2004/0182030 A1 * 9/2004 Hinault et al. ..... 52/403.1
2006/0192683 A1 * 8/2006 Blum et al. ..... 340/691.6
2006/0272229 A1 * 12/2006 Lin ..... 52/177
2007/0258255 A1 * 11/2007 Kessler et al. ..... 362/487

* cited by examiner

Fig. 5
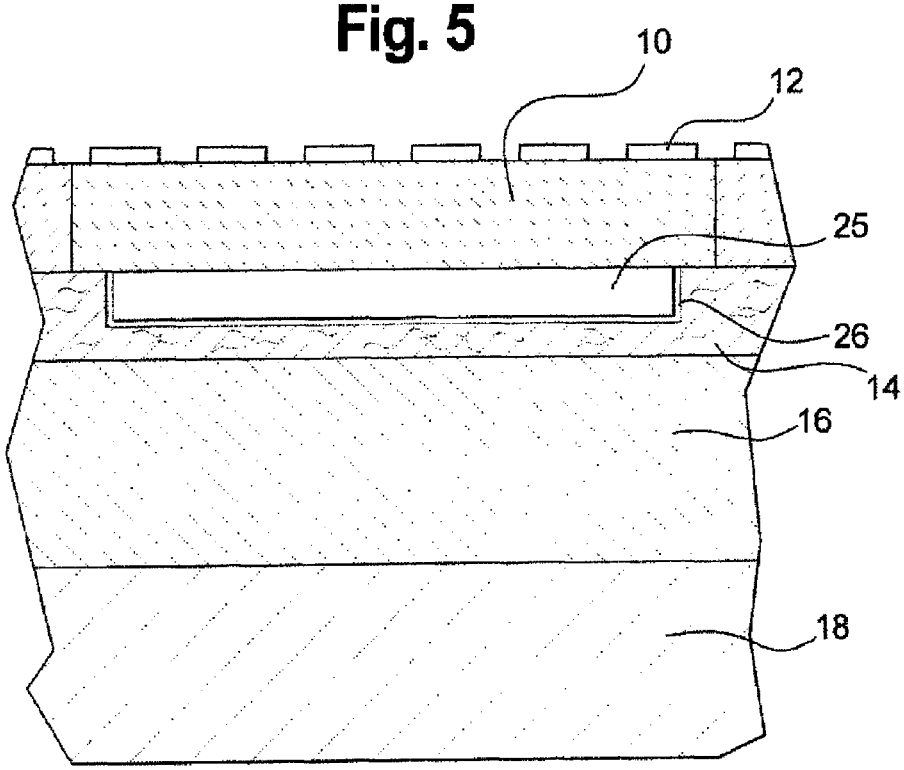
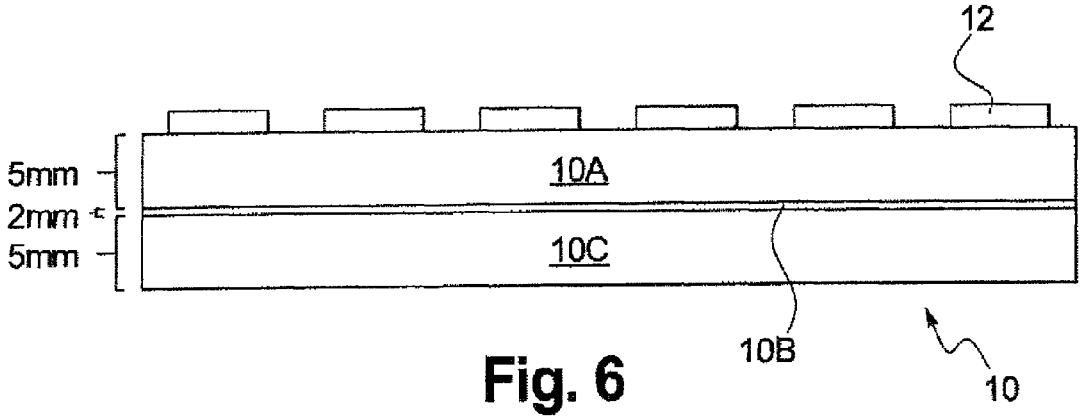
Fig. 6

BASE STRUCTURE FOR SQUASH COURTS

BACKGROUND

The preferred embodiment relates to a base structure for a ball court, particularly a squash court, with a supporting structure resting on a building base or the like and a floor forming a playing surface resting on the supporting structure, as well as a safety glass pane for forming such a base structure.

Known ball courts, particularly squash courts, have base structures of this type with a playing surface, in which an elastic parquet or laminate floor is located on a supporting structure resting on a building base or the like. The elastic structure of the parquet floor gives the playing surface playing characteristics considered pleasant by the player.

However, such base structures can only be used if the base structure is protected against influences of the weather, particularly rain. It has been found that the known base structure is also not completely satisfactory with regards to its antislip characteristics.

SUMMARY

It is an object to provide a base structure in which antislip characteristics are improved and which can be played on virtually throughout the year even when there is an unreliable or completely lacking protection against rain.

The base structure for a ball court, particularly a squash court, has a supporting structure resting on a base and a floor forming a playing surface resting on the supporting structure. The floor comprises a plurality of safety glass panes laid side-by-side and which are freely vertically movable relative to one another and whose surface forming the playing surface is provided with a plurality of rough areas. The supporting structure has an elastic overlay for the safety glass panes.

BRIEF DESCRIPTION OF THE DRAWINGS

FIG. 5 is a cross-sectional view showing the employment of a lighting device not otherwise shown in FIGS. 1-4; and FIG. 6 is a cross-sectional view showing an embodiment for a construction of the glass panes shown in FIGS. 1-4 comprising two individual glass panes with a plastic film therebetween (none of which are shown in FIGS. 1-4 for clarity).

DESCRIPTION OF THE PREFERRED EMBODIMENT

Figure 1:
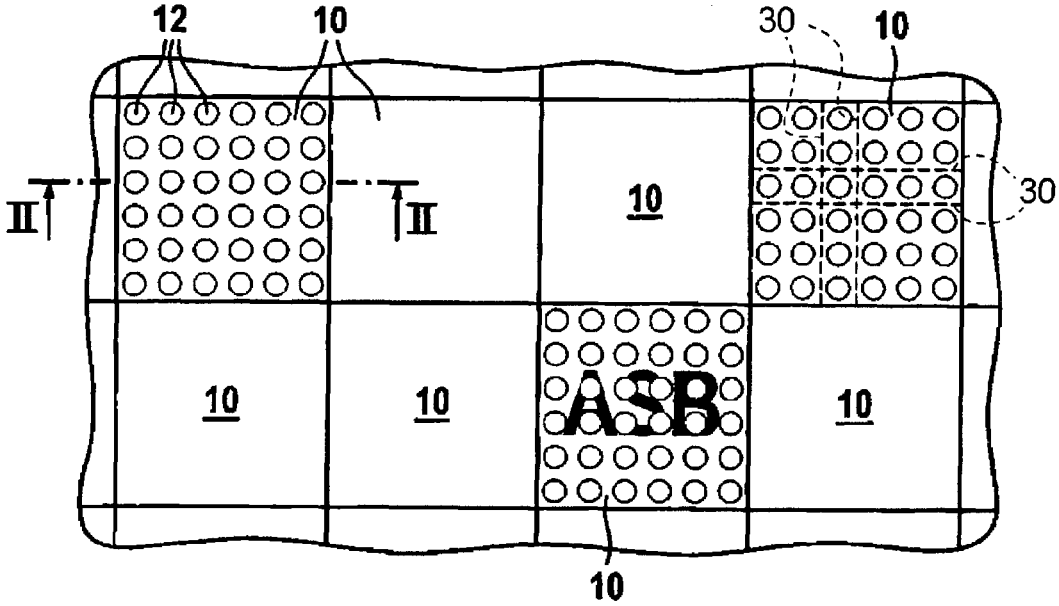
FIG. 1 is an embodiment of a base structure for a squash court or the like according to the preferred embodiment in a diagrammatic plan view.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

The preferred embodiment provides a safety glass pane, which can be used for the equipping of a base structure according to the preferred embodiment in a manner to be described hereinafter.

In a base structure of the aforementioned type, the preferred embodiment solves the problem in a further development in that the floor is formed by a plurality of safety glass panes laid in a substantially jointless manner with abutting lateral edges and which are freely vertically movable relative to one another and whose surface forming the playing surface is provided with a plurality of rough areas, and that the supporting structure has an elastic overlay for the safety glass panes.

The safety glass panes can have a rectangular shape.

The safety glass panes can also have a square shape.

In a further variation the elastic overlay comprises a flexible foam and/or rubber layer.

It is also possible for the elastic overlay to be formed by a plurality of soft foam and/or rubber pads.

It is also possible to provide between the elastic overlay and the safety glass panes a lighting device for the selective rendering visible of marking lines, advertisements and/or impact surfaces.

According to another variation, the safety glass panes are backed on their underside remote from the playing surface with a colored film or the like.

The preferred embodiment also proposes a safety glass pane for equipping or forming a base structure for ball courts, particularly squash courts, which is characterized in that the safety glass pane is constructed as a laminated safety glass pane.

The laminated safety glass pane can have at least two individual silicate glass panes interconnected by means of a laminate plastic film.

It is also possible for at least one of the individual glass panes of the laminated safety glass panes to be constructed as tempered glass panes.

In a further variation the two individual panes of the laminated safety glass pane can in each case have a thickness of 4.0 to 6.0 mm, while the laminated plastic film has a thickness of 1.5 to 2.5 mm.

It is also possible for the thickness of the two individual panes of the laminated safety glass pane to in each case have a thickness of approximately 5.0 mm and for the laminated plastic film to have a thickness of approximately 2.0 mm.

The safety glass pane surface facing the playing surface can also be multiply etched.

In a further variation the rough areas are formed by ceramic colored dots applied in the screen printing process and subsequently fixed on and which have a substantially circular disk shape.

The ceramic dots can have a diameter of 1.5 to 2.5 mm and cover approximately 50% of the safety glass pane surface.

The preferred embodiment is based on the surprising finding that it is possible to create a high quality base structure for squash courts by moving away from the laminate or parquet floor principle previously considered absolutely necessary. In place of this use is made of glass panes, which in conjunction with the correspondingly designed supporting structure have the necessary elasticity, but can be given an antislip finish on the surface thereof by ceramic dots, which are preferably applied in the screen printing process, followed by firing on. The glass pane construction of the floor structure of the preferred embodiment offers the possibility of using corresponding lighting devices to create coloring and marking effects of a random nature, so that it is e.g. unnecessary to have the normally raised marking lines on the playing surface, which significantly increases safety for players.

Moreover, the lighting devices of the aforementioned type, for which naturally the transparency of the safety glass panes used according to the preferred embodiment is of decisive importance, offer the possibility of the corresponding marking of impact surfaces or the like by the umpire.

FIG. 1 shows a detail of a base structure for a ball court, particularly a squash court according to the preferred embodiment. The base structure has a plurality of square safety glass panes 10. All of the safety glass panes are provided with a plurality of ceramic dots 12 (rough areas), although in FIG. 1 only three of the six safety glass panes of the detail of the base structure of a squash court of the preferred embodiment are shown with ceramic dots 12. FIG. 1 makes it clear that through a lighting device not shown in FIGS. 1-4, but shown at 25 embedded in a pocket 26 in carpet layer 14 in FIG. 5 and fitted to the underside of glass pane 10, publicity texts are rendered visible through the safety glass panes 10, such as e.g. in the drawing "ASB", or playing area markings shown by dashed lines 30, as in the case of the top right safety glass pane 10 in FIG. 1. Through the corresponding lighting device 25, which is consequently fitted to the underside of the safety glass panes 10 remote from the playing surface, it is also possible to bring about varied coloring effects when the lighting device 25 is suitably designed. Thus it is possible to adjust the color of the playing surface of FIG. 1 through the color of the ceramic dots 12, selectively also through a lighting device 25 of the aforementioned type, and finally through the nature of the substrate on which the safety glass panes 10 rest. It is e.g. possible for an umpire to differentiate the impact surface with respect to color or brightness from the other playing area zone.

Figure 2:
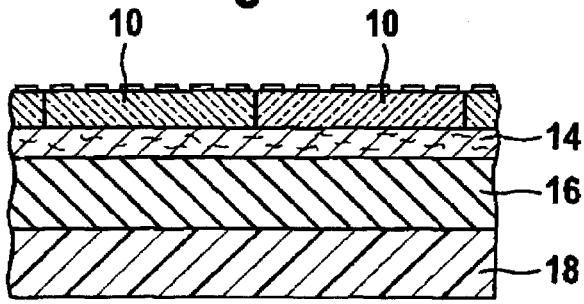
FIG. 2 is a section along line II-II in FIG. 1.

In the embodiment shown in FIG. 2 the safety glass panes 10 rest on a colored carpet layer 14, which in turn rests on a flexible foam layer 16, which rests via a Styrodur layer 18 on the building base or the like.

Figure 3:
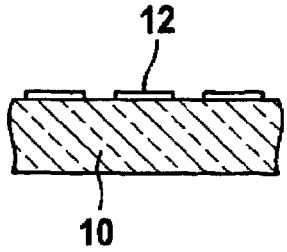
FIG. 3 is a representation corresponding to FIG. 2 of a larger scale section through an area of one of the safety glass panes of the base structure of FIGS. 1 and 2.

The ceramic dots 12 shown in greater detail in FIG. 3 are produced in that the safety glass pane 10 is initially printed in a screen printing process with a ceramic color. The essentially circular dots have a diameter of about 2.0 mm and cover 50% of the glass pane surface. The dots are then fixed onto the glass pane in a one-way process and then, as is shown in FIG. 3, by projecting slightly over the playing surface of the glass pane they give an antislip finish to the latter.

As shown in FIG. 6 (but not shown in FIGS. 1-5), the safety glass panes 10 comprise two individual Danes 10A and 10C and are in each cases 5.0 mm thick. The lower individual pane 10C remote from the playing surface comprises a 5.0 mm thick pane of normal tempered glass (silicate glass). By means of a 2.0 mm thick laminated plastic film 10B, the aforementioned tempered glass pane is joined to an upper silicate glass pane 10A, which is also 5.0 mm thick and to whose top surface facing the playing surface are applied the ceramic dots 12. The laminated film constitutes a splinter proof protection in known manner following the joining together under pressure of the two individual panes of the safety glass panes 10 and such as is, for example the case in motor vehicle windscreens. Following the pressing together of the individual panes of the safety glass panes 10, the laminated film is transparent.

The surface, at the top in FIGS. 2 and 3, of the safety glass panes 10 facing the playing surface is etched 4 to 8 times, so that it does not reflect, but is largely transparent.

Figure 4:
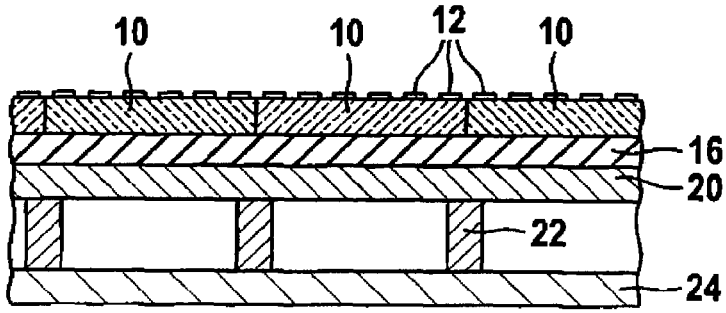
FIG. 4 is a section corresponding to FIG. 2 through a modified embodiment of a base structure according to the preferred embodiment.

In the case of the base structure shown in FIG. 4 a rubber or foam overlay 16 is supported by an aluminum frame 20, which is supported by means of aluminum members 22 on a building base 24. The aluminum construction 22, 24 can be provided with spring elements for further improving the elastic support of the safety glass panes 10 via the flexible foam layer or rubber overlay 16.

The surface area of the complete squash court is 62.5 $m^2$ and for this use is made of 16 identically sized, square safety glass panes 10. The playing surface is 9.75 m long and 6.40 m wide. The base structure generally has a thickness between 7.0 cm and 8.0 cm. If the building base is uneven, this can, for example, be smoothed with quartz silicate. The Styrodur layer preferably has a thickness of approximately 4.0 cm. The preferably roughly 20.0 mm thick flexible foam or rubber layer 16 can be covered with a colored carpet or film 14, as a function of which surface of the safety glass panes 10 is to be visible to the observer. On the film can be laid 16 large safety glass panes with dimensions 1.6 m×2.43 m.

In the preferred embodiment although the safety glass panes are laid in a substantially jointless, abutting manner, they are not connected at their lateral edges, so that there can be an individual height displacement thereof. In conjunction with the elasticity of the substrate, this leads to an excellent elasticity of the playing surfaces, which is gladly accepted by players.

The features of the preferred embodiment disclosed in the description and drawings can be in random combination for the implementation of the different embodiments.

Many other alternatives are envisioned. By way of example only, the following is noted. Although the base structure has been described for a squash court, other types of ball courts may make use of the base structure described herein. The dots may be placed on the safety glass panes may be formed thereon with a variety of techniques. The carpet layer may or may not be employed, although it is preferred. Although rubber or foam is described for the flexible or elastic layer 16, other materials may be employed. Similarly although it is preferred to use a Styrodur layer at 18, other types of supporting layers may be employed. Also the layer 18 may not necessarily rest on a building base but may rest on any type of base. Although the safety glass panes have been described as comprising two individual panes, other constructions may be employed for the safety glass panes. Although the glass panes have been shown to be square, they may have other geometric shapes. Although the panes are preferably laid in close abutting proximity to each others they could also be spaced apart with perhaps a material strip laid therebetween.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

I claim as my invention:

1. A base structure for a ball court, comprising:

a supporting structure resting on a building base and a ball court floor forming a ball playing surface resting on said supporting structure;

the floor comprising a plurality of laminated safety glass panes laid in a jointless manner with side edges directly abutting and each of said plurality of glass panes is freely vertically movable relative to each other and a surface of each glass pane is provided with a plurality of rough areas;

the supporting structure having an elastic overlay elastically supporting all of said panes by supporting an entire bottom surface area of each glass pane; and the laminated safety glass panes each comprising at least two individual silicate glass panes of same peripheral dimensions and a substantially same thickness and interconnected by a laminated plastic film.

2. A base structure according to claim 1 wherein the safety glass panes are rectangular.

3. A base structure according to claim 2 wherein the safety glass panes are square.

4. A base structure according to claim 1 wherein the elastic overlay comprises at least one of the elements selected from the group consisting of a flexible foam and rubber layer.

5. A base structure according to claim 1 wherein the elastic overlay comprises at least one of the elements selected from the group consisting of flexible foam pads and rubber pads.

6. A base structure according to claim 1 wherein a lighting device for the selective rendering visible of at least one of the elements selected from the group consisting of marking lines, advertisements, and impact surfaces is located between the elastic overlay and the safety glass panes.

7. A base structure according to claim 1 wherein an underside remote from the playing surface of the safety glass panes has a colored film beneath the glass panes.

8. A base structure according to claim 1 wherein at least one of the individual glass panes of the laminated safety glass pane is constructed as a tempered glass pane.

9. A base structure according to claim 1 wherein both individual panes of the laminated safety glass pane have a thickness of 4.0 to 6.0 mm corresponding to 0.156 to 0.234 inches and the laminated plastic film has a thickness of 1.5 to 2.5 mm corresponding to 0.058 to 0.097 inches.

10. A base structure according to claim 9 wherein the thickness of both individual panes of the laminated safety glass pane is approximately 5.0 mm corresponding to 0.195 inches and the thickness of the laminated plastic film is approximately 2.0 mm corresponding to 0.078 inches.

11. A base structure according to claim 1 wherein the surface of the safety glass pane facing the playing surface is multiply etched.

12. A base structure according to claim 1 wherein the rough areas are formed by ceramic color dots applied by a screen printing process and which are then fired on and have a substantially circular disk shape.

13. A base structure according to claim 12 wherein the ceramic dots have a diameter of 1.5 to 2.5 mm corresponding to 0.058 to 0.097 inches and cover approximately 50% of the surface of the safety glass pane.

14. A ball court base structure, comprising:

a supporting structure resting on a base and a ball court floor forming a ball playing surface resting on the supporting structure;

the floor comprising a plurality of laminated safety glass panes laid adjacent each other with side edges directly abutting and a surface of each glass pane forming the playing surface is provided with a plurality of rough areas, and wherein each of said plurality of glass panes is freely vertically moveable relative to each other;

a respective selective lighting device beneath at least some of said glass panes;

the supporting structure comprising an elastic layer beneath the safety glass panes elastically supporting all of said panes by supporting an entire bottom surface area of each glass pane; and the laminated safety glass panes each comprising at least two individual silicate glass panes of same peripheral dimensions and a substantially same thickness and interconnected by a laminated plastic film.

15. A ball court base structure of claim 14 wherein the ball court comprises a squash court.

16. A ball court base structure, comprising:

a supporting structure resting on a base and a ball court floor forming a ball playing surface resting on the supporting structure;

the floor comprising a plurality of laminated safety glass panes laid side-by-side with edges directly abutting and wherein each of said plurality of glass panes is freely, vertically movable relative to each other and a surface of each of the glass panes forming the playing surface is provided with a plurality of raised dots;

the supporting structure comprising an elastic layer beneath the safety glass panes elastically supporting all of said panes by supporting an entire bottom surface area of each glass pane; and the laminated safety glass panes each comprising at least two individual silicate glass panes of same peripheral dimensions and a substantially same thickness and interconnected by a laminated plastic film.

* * * * *